United States Patent [19]

Lamminen et al.

[11] Patent Number: 4,964,956

[45] Date of Patent: Oct. 23, 1990

[54] METHOD OF AND A DEVICE FOR LEADING A WEB MOVING BETWEEN TWO WIRES ON TO A DESIRED WIRE

[75] Inventors: Veikko Lamminen; Erkki Hietikko; Ilpo Kylmäkorpi, all of Tampere, Finland

[73] Assignee: Oy Tampella AB, Tampere, Finland

[21] Appl. No.: 206,230

[22] Filed: Jun. 13, 1988

[30] Foreign Application Priority Data

Jun. 30, 1987 [FI] Finland ..... 872882

[51] Int. Cl.[5] ..... D21F 9/02

[52] U.S. Cl. ..... 162/203; 162/217; 162/301; 162/363

[58] Field of Search ..... 162/203, 208, 210, 301, 162/306, 352, 363, 374, 300, 217

[56] References Cited

U.S. PATENT DOCUMENTS

| | | | |
|---|---|---|---|
| 4,146,424 | 3/1979 | Justus | 162/203 X |
| 4,154,645 | 5/1979 | Kankaanpää162 | 301 X/ |
| 4,176,005 | 11/1979 | Bubik et al. | 162/301 X |
| 4,207,144 | 6/1980 | Meinecke et al. | 162/352 X |
| 4,614,566 | 9/1986 | Koponen et al. | 162/301 |
| 4,714,521 | 12/1987 | Fujiwara | 162/301 X |

*Primary Examiner*—Peter Chin
*Assistant Examiner*—Thi Dang
*Attorney, Agent, or Firm*—Ladas & Parry

[57] ABSTRACT

A method of and an arrangement for leading a web on to a desired wire in a paper machine or the like. When the web moves between two wires, it is transferred on to one wire after the wires have moved in parallel over a distance with the web therebetween making contact with both wires. The transfer takes place when the wires start to move in different directions by sucking the web on to one of the wires by a vacuum acting through said wire. For improving the detachment of the web from the other wire, the direction of travel of the wire is changed abruptly at the parting point of the wires by leading it along a suction box comprising a cover piece formed by cleats and arranged to form an angle in such a way that the point of the angle projects towards the wire. When the wire moves along the cleats of the cover piece of the suction box, its direction of travel is abruptly changed at the point line of the angle, whereby the web is detached from the other wire completely in a moment.

9 Claims, 1 Drawing Sheet

METHOD OF AND A DEVICE FOR LEADING A WEB MOVING BETWEEN TWO WIRES ON TO A DESIRED WIRE

This invention relates to a method of guiding a web on to a desired wire in a paper machine or the like, wherein the web moves essentially in parallel with a first wire and a second wire over a part of the length of the wires in such a manner that the web is positioned between the wires and makes contact with both wires, whereafter the wires are arranged to part from each other, and the web is detached from one of the wires at a parting point of the wires and caused to follow the other wire by exposing it to a vacuum at least at the parting point through the wire which it is to follow. The invention is also concerned with an arrangement for leading a paper web on to a desired wire.

Within the range of action of or immediately after the formers of paper or paper board machines or anywhere where it is necessary that the web follows a desired wire, the passage of the wire has previously been controlled by means of suction boxes or suction rolls having straight or arched cover pieces. This kind of solution is known e.g. from U.S. Pat. No. 4,623,429.

U.S. Pat. No. 4,623,429 discloses a solution in which a web formed on a first wire of the former is transferred on to a second wire by means of a suction roll positioned within the loop formed by the second wire. A vacuum in the suction roll detaches the web from the first wire so that it is transferred on to the second wire.

In solutions known from the prior art it cannot always be ensured that the web passes on in a controlled manner; on the contrary, the web may start to flutter after a point at which the wires part from each other, which easily leads to the breaking of the web. This, of course, causes unnecessary costs.

The object of the invention is to improve the detachment of the web from between two wires on to a desired wire and to prevent the fluttering of the web after the parting point of the wires. In the invention this is achieved by abruptly changing the direction of travel of at least one of the wires at the parting point of the wires so that the directions of travel of the wire portions at opposite sides of the parting point are at an angle with respect to each other.

By means of the solution according to the invention, a web which follows one of the wires at the parting point of the wires is detached from the other wire essentially linearly, whereby the detachment takes place abruptly immediately after the parting point and the web follows the desired wire. In this way, the web does not tend to flutter but follows the desired wire neatly and evenly. Correspondingly, the liability to breakage of the web is decreased and thus unnecessary stoppages become fewer.

Figure 1:
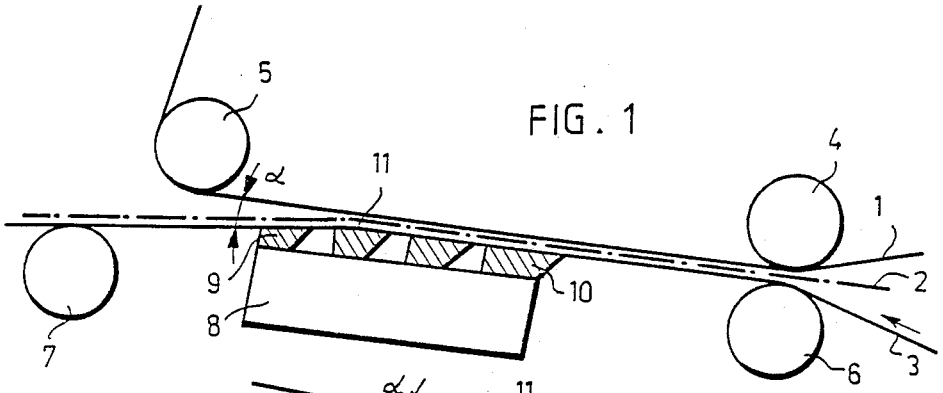
Figure 2:
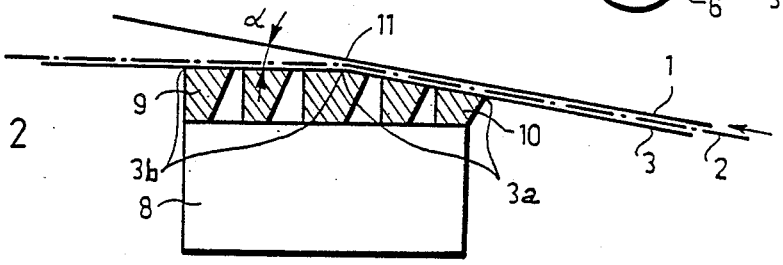
Figure 3:
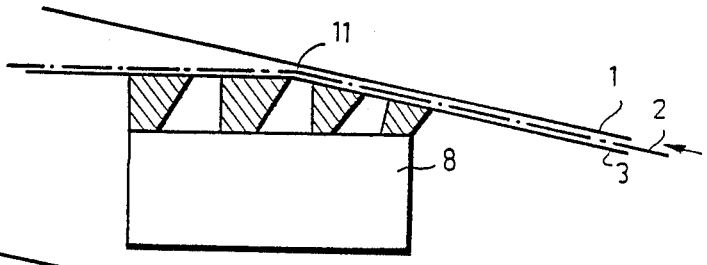
Figure 4:
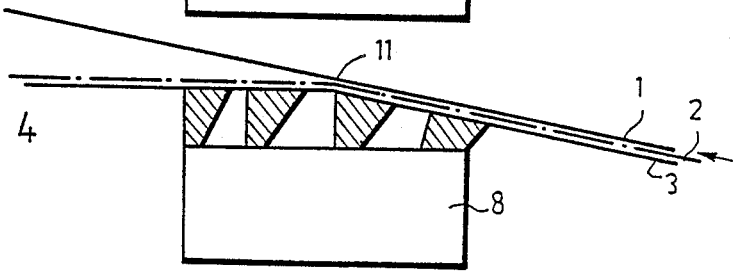
Figure 5:
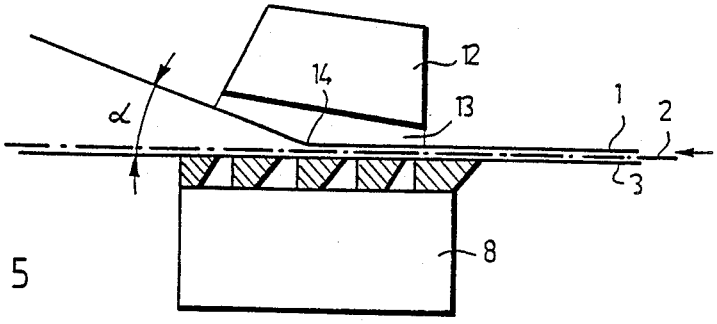

The invention will be described in more detail in the attached drawings, wherein FIG. 1 a schematical view of a former section of a paper or paper board machine in which a formed web follows a desired wire;

FIG. 2 is a more detailed view of one preferred embodiment of the invention shown in FIG. 1; and FIGS. 3, 4 and 5 are detailed views of some further embodiments of the invention.

FIG. 1 shows a former in a paper machine. The former comprises a first wire 1 or an upper wire; a web 2; and a second wire 3 or a lower wire which the web 2 follows after a point at which the wires part from each other. The upper wire 1 moves around rolls 4 and 5 and further around stretch and guide rolls (not shown), thus forming an endless loop. In the embodiment of FIG. 1, the upper wire 1 is essentially straight between the rolls 4 and 5. The lower wire 2 moves around rolls 6 and 7 and around other rolls not shown, such as guide and stretch rolls, thus likewise forming an endless loop. In addition, the lower wire 3 is led along the surface of a suction box 8, whereby a cover piece 9 on the suction box is formed by cleats 10. The cleats 10 are shaped in such a manner that planes extending in parallel to their upper surfaces form a distinct angle in the middle of the suction box 8. As a consequence, the direction of travel of the lower wire 3 moving along the cleats 10 is changed abruptly at a line 11 extending through the point of the angle, thereby deviating from the direction of travel of the upper wire 1 at an angle $\alpha$. Due to a vacuum effect exerted on the web 2 through the lower wire 3 by the suction box 8, the web 2 follows the lower wire 3, parting essentially abruptly, i.e., linearly, from the upper wire 1.

The suction box 8 comprises means (not shown) for creating a vacuum. Furthermore, cleaning and dewatering means not shown are provided for the wires 1 and 3. All these are generally known.

FIG. 2 is a more detailed view of the device around the suction box 8. It appears from the figure that the lower wire 3 moves along the surface of the cleats 10 forming the cover piece 9 of the suction box 8, whereby the direction of the wire is changed at the line 11 extending through the point of the angle of the cover piece in such a manner that an angle is formed between a wire portion 3*a* before the point line 11 and a wire portion 3*b* after the line 11.

The upper wire 1, after having been passed from the roll 4 to the suction box 8 in parallel with the lower wire 3 with the web 2 positioned between the wires 1 and 3, continues its movement in the same direction after the line 11, so that it does not any longer make contact with the web 2 after said line.

In the embodiment of FIG. 3, the point line 11 is formed by a leading edge of the cleat 10 seen in the direction of travel of the web.

In the embodiment of FIG. 4, in turn, the point line is formed by a trailing edge of the cleat 10.

In the embodiment of FIG. 5, the direction of travel of the lower wire 3 is essentially straight; the upper wire 1, instead, is caused to change its direction of travel abruptly by means of a separate shoe 12. A cover piece 13 on the shoe 12 is shaped so that it comprises two slide surfaces which are at an angle with respect to each other. The upper wire 1 thereby changes its direction of travel at a line 14 extending through the point of the angle formed by the surfaces, thus parting from the web 2 and the lower wire 3, which reached the shoe 12 in parallel therewith.

By changing the direction of travel of at least one wire abruptly according to the invention, the web can be transferred reliably and evenly by means of a single suction box. Irrespective of whether a suction box is used as a shoe for changing the direction or whether a separate shoe positioned opposite to a suction box is used, the suction box is preferably constructed by means of cleats. The suction box is thereby less liable to clogging than conventional suction boxes.

In place of straight shoe surfaces, it is possible to use surfaces arched to some extent, whereby instead of a plane, the wire moves along a surface within the area of the shoe. Essential is, however, that the shoe comprises a distinct edge at a point where the wires are to be parted. The edge is formed along a line defined by the point of an angle formed between the surfaces along which the wire moves before and after the parting point. Correspondingly, the cover piece or the cleats of the suction box can be dimensioned according to the same principle.

Even though it has been mentioned above that the first wire is the upper wire and the second wire is the lower wire, the invention is not restricted to this position of the wires but the direction of the wires can be as desired. Furthermore, the web can be passed on together with either wire or as a free transfer. The invention is equally suitable for use in paper and paper board machines as well as in other machines operating in a similar way. Instead of abruptly changing the direction of travel of one wire only, it is possible to change the direction of travel of both wires.

We claim:

1. A method of guiding a web onto a desired wire in a paper machine, wherein the web is first guided between a first wire and a second wire so as to contact both wires and to be moved along a length of said wires in a parallel arrangement with said wires, whereafter, the wires are arranged to part abruptly from each other at a parting point by a shoe having a surface which is positioned adjacent to one of said wires; said surface comprises two planes forming a distinct angle and intersecting to form a line in said surface; said line defining said parting point; wherein said wires and said web are arranged to move in said parallel arrangement along one of said planes of said surface and then to part from each other at said parting point; one of said wires is arranged to follow along the other plane of said surface after the parting point so that the direction of travel of one of the wires is abruptly changed at the parting point, and the web is detached from said first wire, and caused to follow the second wire by applying a vacuum, through said second wire, to the web at the parting point.

2. An arrangement for leading a web onto a desired wire at a parting point of two wires in a paper machine comprising at least a first wire and a second wire arranged to move essentially in parallel with each other over a part of their length and to part thereafter so as to move away from each other; means for guiding the wires, whereby the web to be led between the first wire and the second wire will be moved therewith over the parallel length thereof in such a way that the web will simultaneously make contact with both wires; a separation means, located at said parting point and adjacent to said guide means, having a surface which is positioned adjacent to one of said wires; said surface comprises two planes forming a distinct angle and intersecting to form a line in said surface; said line defining said parting point; wherein said wires and said web are arranged to move in said parallel arrangement along one of said planes of said surface and then to part from each other at said parting point; one of said wires is arranged to follow along the other plane of said surface after the parting point so that the direction of travel of one of the wires is abruptly changed at the parting point; and vacuum means, positioned at the parting point of the wires and adjacent to said second wire, so as to draw the web against said second wire so that said web to be transferred onto said second wire once the wires have been separated.

3. An arrangement according to claim 2, wherein said separation means comprises a shoe.

4. An arrangement according to claim 3, wherein the shoe is arranged to form a cover piece of the vacuum means, the cover piece comprising openings for providing a suction effect and for drawing water, and that the shoe is mounted between said vacuum means and said second wire so as to contact said second wire.

5. An arrangement according to claim 4, wherein the cover piece forming the shoe is formed by separate cleats fastened to the vacuum means, the surface which contacts the second wire being defined by top surfaces of the cleats.

6. An arrangement according to claim 5, wherein the distinct angle is formed in a single cleat.

7. An arrangement according to claim 5, wherein the distinct angle is formed by a leading edge of one of the cleats.

8. An arrangement according to claim 5, wherein the distinct angle is formed by a trailing edge of one of the cleats.

9. An arrangement according to claim 2, wherein said separation means comprises a shoe, whereby said first wire is arranged to contact said shoe, and to be abruptly changed in its direction of travel at the parting point.

* * * * *